US009694887B2

(12) United States Patent
Lee et al.

(10) Patent No.: US 9,694,887 B2
(45) Date of Patent: Jul. 4, 2017

(54) PROPULSION DEVICE FOR SHIP AND SHIP HAVING THE SAME

(75) Inventors: Jin Suk Lee, Yuseong-gu (KR); Ji Nam Kim, Tongyeong-si (KR); Hyun Sang Park, Geoje-si (KR); Hyung Gil Park, Yuseong-gu (KR); Kwang Jun Paik, Yuseong-gu (KR); Dong Hyun Lee, Yuseong-gu (KR); Tae Goo Lee, Yuseong-gu (KR); Sung Wook Chung, Geoje-si (KR); Tetsuji Hoshino, Seo-gu (KR); Jong Soo Seo, Yuseong-gu (KR); Seung Myun Hwangbo, Yuseong-gu (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 784 days.

(21) Appl. No.: 14/126,801

(22) PCT Filed: Sep. 23, 2011

(86) PCT No.: PCT/KR2011/007025
§ 371 (c)(1),
(2), (4) Date: Oct. 13, 2014

(87) PCT Pub. No.: WO2012/173306
PCT Pub. Date: Dec. 20, 2012

(65) Prior Publication Data

US 2015/0030452 A1 Jan. 29, 2015

(30) Foreign Application Priority Data

Jun. 15, 2011 (KR) ..... 10-2011-0058053

(51) Int. Cl.
*B63H 5/10* (2006.01)
*B63H 23/02* (2006.01)
(Continued)

(52) U.S. Cl.
CPC ..... *B63H 5/10* (2013.01); *B63H 1/04* (2013.01); *B63H 5/125* (2013.01); *B63H 5/14* (2013.01);
(Continued)

(58) Field of Classification Search
CPC . B63H 5/14; B63H 5/10; B63H 23/02; B63H 21/386; B63H 21/12
See application file for complete search history.

(56) References Cited

U.S. PATENT DOCUMENTS 3,580,214 A 5/1971 Muller
4,642,059 A * 2/1987 Nohara ..... B63H 5/10 416/129
(Continued)

FOREIGN PATENT DOCUMENTS

AU 697351 4/1996
JP 61-44099 3/1986
(Continued)

OTHER PUBLICATIONS

International Preliminary Report on Patentability (Chapter II) for PCT/KR2011/007025 dated Aug. 19, 2013 and its English translation from WIPO.
(Continued)

*Primary Examiner* — Woody Lee, Jr.
(74) *Attorney, Agent, or Firm* — Ladas & Parry, LLP

(57) ABSTRACT

Disclosed are a propulsion device for a ship and a ship having same. The propulsion device, according to an embodiment of the present invention, comprises: a rear propeller fixed to a driveshaft; a front propeller positioned in front of the rear propeller, and supported rotably on the driveshaft; and a counter rotation device for reversing and transmitting the rotation of the driveshaft to the front propeller; a motor for rotating the driveshaft; and an housing,
(Continued)

which extends from to the lower part of the hull, and which is installed so as to envelope the counter rotation device and the motor.

6 Claims, 6 Drawing Sheets

(51) Int. Cl.

| | |
|---|---|
| ***B63H 5/14*** | (2006.01) |
| ***B63H 1/04*** | (2006.01) |
| ***B63H 21/12*** | (2006.01) |
| ***B63H 5/125*** | (2006.01) |
| ***B63H 21/38*** | (2006.01) |
| *B63H 23/06* | (2006.01) |
| *B63H 23/32* | (2006.01) |

(52) U.S. Cl.
CPC ..... *B63H 21/12* (2013.01); *B63H 21/386* (2013.01); *B63H 23/02* (2013.01); *B63H 23/321* (2013.01); *B63H 2005/103* (2013.01); *B63H 2005/106* (2013.01); *B63H 2005/1258* (2013.01); *B63H 2023/0283* (2013.01); *B63H 2023/067* (2013.01); *B63H 2023/323* (2013.01)

(56) References Cited

U.S. PATENT DOCUMENTS

| | | | | |
|---|---|---|---|---|
| 4,792,314 | A | 12/1988 | McCormick | |
| 5,009,621 | A * | 4/1991 | Bankstahl | B63H 5/10 416/129 |
| 5,501,623 | A * | 3/1996 | Bowen, III | B63H 23/30 440/75 |
| 5,632,658 | A | 5/1997 | Chen et al. | |
| 5,722,866 | A * | 3/1998 | Brandt | B63H 5/125 440/61 R |
| 2005/0009418 | A1* | 1/2005 | Ries | B63H 5/125 440/6 |
| 2007/0224892 | A1* | 9/2007 | Davis | B63H 5/16 440/68 |
| 2010/0178817 | A1* | 7/2010 | Choi | B63H 5/10 440/51 |

FOREIGN PATENT DOCUMENTS

| | | |
|---|---|---|
| JP | 61-144454 | 7/1986 |
| JP | 63-217968 | 9/1988 |
| JP | 7-251795 | 10/1995 |
| JP | 9-30496 | 2/1997 |
| JP | 2004-249820 | 9/2004 |
| JP | 2004-291709 | 10/2004 |
| JP | 2010-528918 | 8/2010 |
| KR | 1985-0001108 | 3/1985 |
| WO | 98/29300 | 7/1998 |
| WO | 04/000640 | 12/2003 |

OTHER PUBLICATIONS

Written Opinion of the International Searching Authority for PCT/KR2011/007025 mailed on Apr. 4, 2012 and its English machine translation by Google Translate.
International Search Report for PCT/KR2011/007025 mailed on Apr. 4, 2012 and its English translation from WIPO.
Office Action dated Dec. 24, 2014 for Japanese Patent Application No. 2014-515702.
Extended European Search Report dated Dec. 8, 2015 for European Patent Application No. 11867843.2.

* cited by examiner

PROPULSION DEVICE FOR SHIP AND SHIP HAVING THE SAME

CROSS-REFERENCE TO RELATED APPLICATIONS

This application is the U.S. National Stage of International Patent Application No. PCT/KR2011/007025 filed on Sep. 23, 2011, which claims priority to Korean Patent Application No. 10-2011-0058053, filed on Jun. 15, 2011 the disclosures of which are hereby incorporated in their entireties by reference.

TECHNICAL FIELD

Embodiments of the present invention relate to a ship propulsion device and a ship having the same, and more particularly to a ship propulsion device in which two propellers generate propulsive force via counter rotation thereof and a ship having the same.

BACKGROUND ART

Ships have a propulsion device to generate propulsive force for sailing. In general, a single propeller is used in the propulsion device. However, the propulsion device having a single propeller cannot acquire propulsive force from rotational energy of water streams, and thus causes substantial energy loss.

A Counter Rotating Propeller (CRP) type propulsion device is a device that acquires propulsive force from rotational energy without energy loss. In the counter rotating propeller type propulsion device, two propellers installed on the same axis generate propulsive force via counter rotation thereof. A rear propeller of the counter rotating propeller type propulsion device is rotated in reverse with respect to a rotating direction of a front propeller, thereby acquiring propulsive force from rotational energy of fluid caused by the front propeller. Accordingly, the counter rotating propeller type propulsion device may exhibit higher propulsion performance than the aforementioned propulsion device having a single propeller.

The counter rotating propeller type propulsion device includes an inner shaft connected to an engine within a hull, a rear propeller coupled to a rear end of the inner shaft, a hollow outer shaft rotatably installed around an outer surface of the inner shaft, and a front propeller coupled to a rear end of the outer shaft. In addition, the counter rotating propeller type propulsion device includes a counter rotation unit installed within the hull to reverse rotating direction of the inner shaft and transmit reversed rotation to the outer shaft. A typical planetary gear mechanism is used as the counter rotation unit.

However, in the case of the above-described counter rotating propeller type propulsion device, the hollow outer shaft has difficulty in center alignment with respect to the inner shaft upon installation of the counter rotating propeller type propulsion device to a ship. In addition, the outer shaft needs an increased lubrication area for reduction in friction between the inner shaft and the outer shaft. The counter rotation of the inner shaft and the outer shaft causes shear of a lubrication layer between the inner shaft and the outer shaft, which makes it difficult to realize efficient lubrication.

Meanwhile, in the case of a typical azimuth thruster system, a propeller is rotatable within a range of 360 degrees to enable free forward and rearward propulsion or rotation of a ship. For example, azimuth thrusters, azipods, and the like are used in the azimuth thruster system. The azimuth thruster system is used in various ships including drill ships, icebreakers, shuttle tankers, floating production storage and offloading (FPSO) vessels, polar sailing cargo ships, passenger ships, and the like, owing to control performance and various other advantages.

However, in case of applying a propulsion method of the above-described counter rotating propeller type propulsion device to the typical azimuth thruster system, the same problems as those of the typical counter rotating propeller type propulsion device may occur, and there is a need for a more effective counter rotating propeller type propulsion device.

DISCLOSURE

Technical Problem

It is an embodiment of the present invention to provide a ship propulsion device which may realize counter rotation of two propellers even without an outer shaft and a ship having the same.

In addition, it is another embodiment of the present invention to provide a ship propulsion device which applies a propulsion method to enable counter rotation of two propellers without an outer shaft to an azimuth propulsion method and a ship having the same.

Technical Solution

In accordance with one aspect of the present invention, a ship propulsion device includes a rear propeller fixed to a drive shaft, a front propeller rotatably supported by the drive shaft in front of the rear propeller, a counter rotation unit configured to reverse rotating direction of the drive shaft and transmit reversed rotation to the front propeller, a motor configured to rotate the drive shaft, and a housing configured to extend downward from a stern part of a hull and surround the counter rotation unit and the motor.

The counter rotation unit may include a driving bevel gear fixed to the drive shaft, a driven bevel gear fixed to a hub of the front propeller, and one or more reverse bevel gears configured to reverse rotating direction of the driving bevel gear and transmit reversed rotation to the driven bevel gear.

Shafts of the reverse bevel gears installed in a direction crossing the drive shaft to support the reverse bevel gears may further be provided.

A casing configured to support the shafts of the reverse bevel gears may further be provided.

A first cylindrical lining attached to a front surface of the hub of the front propeller for sealing between the hub of the front propeller and a rear surface of the housing, and a first cylindrical sealing member installed to the rear surface of the housing so as to come into contact with an outer surface of the first lining may further be provided.

A second cylindrical lining attached to a front surface of a hub of the rear propeller for sealing between the hub of the rear propeller and the hub of the front propeller, and a second cylindrical sealing member installed to a rear surface of the front propeller so as to come into contact with an outer surface of the second lining may further be provided.

In accordance with another aspect of the present invention, a ship including a ship propulsion device is provided.

Advantageous Effects

A ship propulsion device and a ship having the same according to the embodiment of the present invention may realize counter rotation of two propellers without an outer shaft.

Further, applying a propulsion method that enables counter rotation of two propellers without the outer shaft to an azimuth propulsion method may enhance propulsion efficiency.

Furthermore, owing to absence of the outer shaft, installation of a drive shaft as well as center alignment of the installed drive shaft may be easily implemented.

In addition, absence of the outer shaft may reduce a required lubrication area than the related art and minimize problems due to lubrication.

BEST MODE

The exemplary embodiments of the present invention will hereinafter be described in detail with reference to the accompanying drawings.

Figure 1:
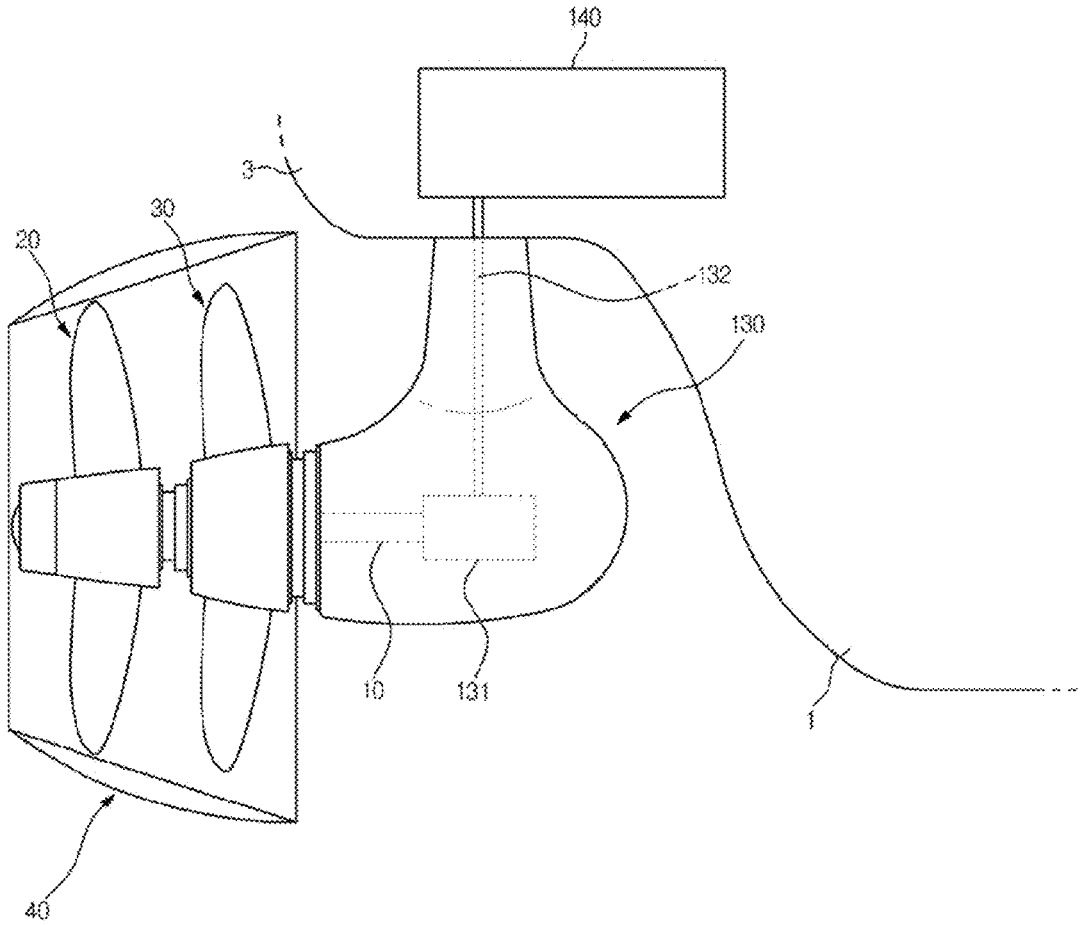
FIG. 1 is a sectional view showing a propulsion device applied to a ship according to an embodiment of the present invention.

As exemplarily shown in FIG. 1, the propulsion device according to the embodiment of the present invention is a counter rotating propeller type propulsion device which is mounted to a stern part 3 of a hull 1 and generates propulsive force via counter rotation of two propellers 20 and 30. The propulsion device may enhance propulsion efficiency using a duct 40 installed to surround the propellers 20 and 30. The duct 40 may have a hydrodynamic streamlined shape. In addition, the propulsion device may include a steering unit (not shown) within the hull 1 to change the direction of propulsive force applied to the hull 1 by the front propeller 30 and the rear propeller 20 to all directions (360 degrees).

Figure 2:
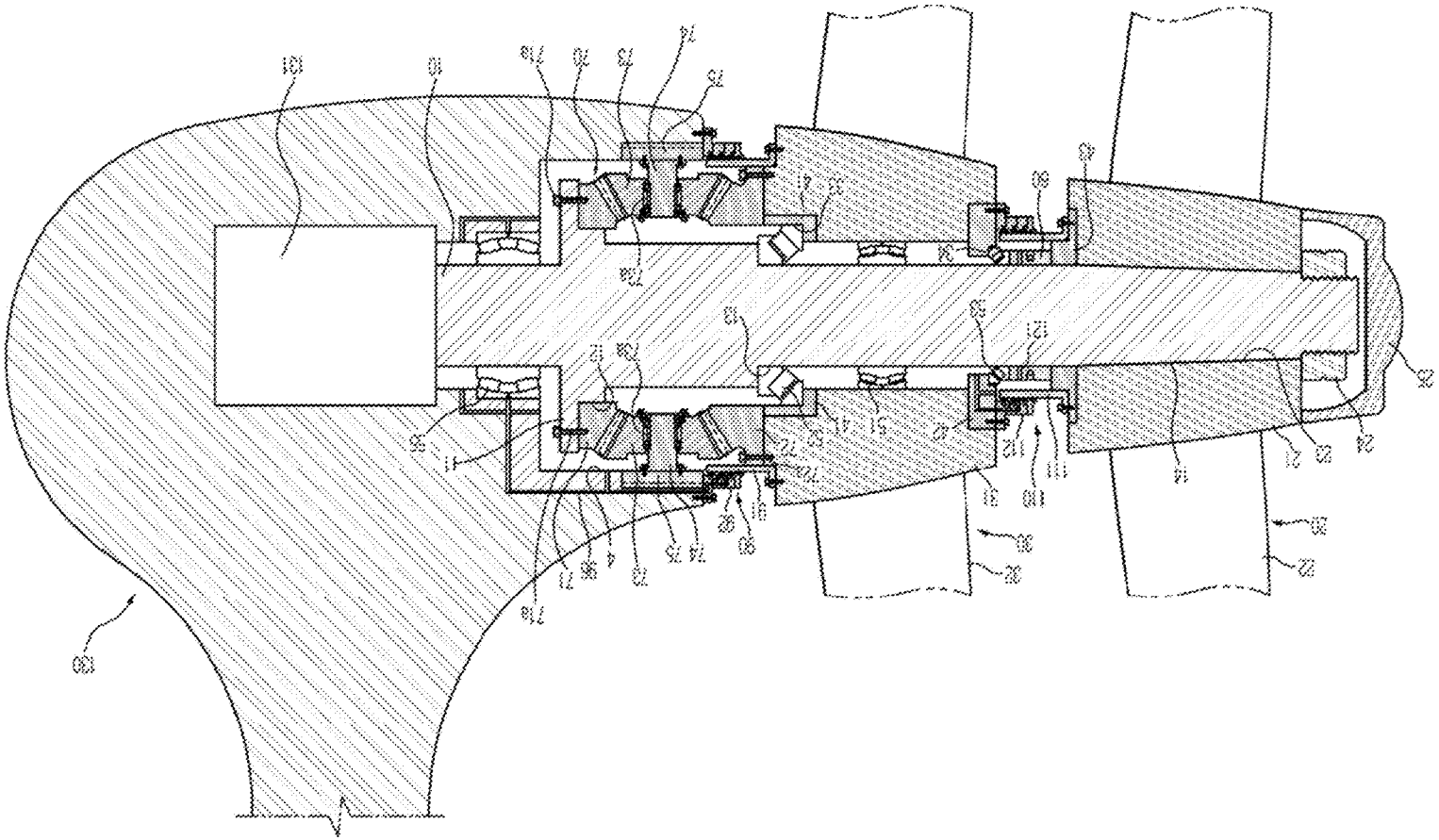
FIG. 2 is a sectional view of the propulsion device according to the embodiment of the present invention.

As exemplarily shown in FIGS. 1 and 2, the propulsion device according to the embodiment of the present invention includes the rear propeller 20 fixed to a drive shaft 10, the front propeller 30 rotatably supported by the drive shaft 10 in front of the rear propeller 20, a counter rotation unit 70 configured to reverse rotating direction of the drive shaft 10 and transmit reversed rotation to the front propeller 30, a motor 131 that rotates the drive shaft 10, and a housing 130 installed to extend downward from a hull stern part 3 and surround the counter rotation unit 70 and the motor 131. In this case, the hull 1 may be provided with a drive source 140 (e.g., generator, or engine) to supply power to the motor 131 via a line 132 and the steering unit (not shown) to change a course of the ship to the portside or the starboard. The steering unit may change the direction of propulsive force applied to the hull 1 by the front propeller 30 and the rear propeller 20 using a steering gear, and the like.

The drive shaft 10, as exemplarily shown in FIG. 2, has a multi-stepped outer surface for sequential installation of the counter rotation unit 70, the front propeller 30, and the rear propeller 20 thereon. The drive shaft 10 includes a flange portion 11 having a first stepped portion 12 where the counter rotation unit 70 is disposed, and a second stepped portion 13 at the rear of the flange portion 11 for installation of the front propeller 30, the second stepped portion having a smaller outer diameter than that of the first stepped portion 12. In addition, the drive shaft includes a tapered portion 14 at the rear of the second stepped portion 13 for installation of the rear propeller 20, an outer diameter of which is gradually reduced rearward. The flange portion 11 may be integrated with the drive shaft 10, or may be prefabricated and then fixed to an outer surface of the drive shaft 10 via press fitting.

The rear propeller 20 includes a hub 21 fixed to a tail portion of the drive shaft 10 and a plurality of blades 22 arranged on an outer surface of the hub 21. The rear propeller 20 is fixed to the drive shaft 10 as an outer surface of the tapered portion 14 of the drive shaft 10 is press-fitted into a center shaft-coupling bore 23 of the hub 21. In addition, the rear propeller is more firmly fixed to the drive shaft 10 as a fixing nut 24 is fastened to a rear end of the drive shaft 10. To achieve this coupling, the shaft-coupling bore 23 of the hub 21 may have a shape corresponding to the outer surface of the tapered portion 14 of the drive shaft 10. In FIG. 2, reference numeral 25 designates a propeller cap that is mounted to the rear propeller hub 21 to cover the rear end of the drive shaft 10 and a rear surface of the rear propeller hub 21.

The front propeller 30 is rotatably coupled to the outer surface of the drive shaft 10 at a position forwardly spaced apart from the rear propeller 20. The front propeller 30 includes a hub 31 rotatably supported by the outer surface of the drive shaft 10 and a plurality of blades 32 arranged on an outer surface of the hub 31. The front propeller 30 and the rear propeller 20 are configured to implement counter rotation, and therefore blade angles of the front and rear propellers are opposite to each other.

The hub 31 of the front propeller 30 is rotatably supported at the center thereof by a radial bearing 51, and is rotatably supported at both sides thereof by a front thrust bearing 52 and a rear thrust bearing 53 respectively.

The front thrust bearing 52 has an inner race supported by an edge of the second stepped portion 13 of the drive shaft 10 and an outer race supported by a front bearing support portion 33 of the hub 31. The rear thrust bearing 53 has an inner race supported by a support ring 60 so as not to be axially pushed, the support ring being mounted on the outer surface of the drive shaft 10, and an outer race supported by a rear bearing support portion 34 of the hub 31. In this case, the radial bearing 51 serves to bear radial load of the front propeller 30 applied in a radial direction of the drive shaft 10, and the front and rear thrust bearings 52 and 53 serve to bear thrust load applied to the drive shaft 10 in both axial front and rear directions. In particular, the front thrust bearing 52 serves to bear thrust load applied from the front propeller 30 to the bow during forward movement of the ship, and the rear thrust bearing 53 serves to bear thrust load applied from the front propeller 30 to the stern during rearward movement of the ship.

The hub 31 of the front propeller 30 may be provided with reinforcing members 41 and 42 respectively at positions where the front and rear bearing support portions 33 and 34 are provided. Providing the reinforcing members 41 and 42 respectively at installation positions of the front thrust bearing 52 and the rear thrust bearing 53 increases rigidity of the hub 31. The reinforcing members 41 and 42 may be formed of steel that is more rigid than the hub 31. In the same manner, a reinforcing member 43 may further be provided at a front surface of the hub 21 of the rear propeller 20 at a portion thereof to come into contact with the support ring 60.

Here, after the front propeller 30 and the rear thrust bearing 53 are mounted to the first drive shaft 10, the hub 21 of the rear propeller 20 may be coupled to the first drive shaft 10 via press fitting, and then the support ring 60 may be interposed between the rear propeller hub 21 and the rear thrust bearing 53. The reason why the support ring 60 is installed as described above is because accurately maintaining a distance between the rear thrust bearing 53 and the rear propeller hub 21 is difficult due to a coupling error of the rear propeller caused according to circumstances when the rear propeller 20 is press-fitted to the first drive shaft 10. Accordingly, after the rear propeller 20 is first assembled, a distance between the rear thrust bearing 53 and the rear propeller hub 21 is measured, and the support ring 60 is fabricated to correspond to the distance. In this way, accurate coupling of the support ring and the first drive shaft 10 may be achieved.

The counter rotation unit 70, as exemplarily shown in FIG. 2, is mounted to a tail of the housing 130 adjacent to the hub 31 of the front propeller 30. To this end, the tail of the housing 130 may define an installation space 4 in which the counter rotation unit 70 may be received. The installation space 4 may have a cylindrical shape, the center of which coincides with the center of the drive shaft 10. A rear side of the installation space facing the front propeller hub 31 is open.

The counter rotation unit 70 includes a driving bevel gear 71 fixed to the flange portion 11 of the drive shaft 10 so as to rotate along with the drive shaft 10, a driven bevel gear 72 fixed to a front surface of the hub 31 of the front propeller 30 so as to face the driving bevel gear 71, and a plurality of reverse bevel gears 73 to reverse rotating direction of the driving bevel gear 71 and transmit reversed rotation to the driven bevel gear 72. In addition, to support a plurality of reverse bevel gear shafts 74, the counter rotation unit includes a cylindrical casing 75 configured to surround the reverse bevel gears 73.

The driving bevel gear 71 is fixed to the flange portion 11 as a plurality of fixing bolts 71*a* is fastened to the driving bevel gear supported by the first stepped portion 12 of the flange portion 11. The driven bevel gear 72 is fixed to the hub 31 as a plurality of fixing bolts 72*a* is fastened to the driven bevel gear in a state in which a rear surface of the driven bevel gear comes into contact with the front propeller hub 31. In addition, an inner diameter portion of the driven bevel gear 72 is spaced apart from an outer surface of the drive shaft 10 to prevent generation of friction during rotation thereof. Although FIG. 2 shows a coupling method of the driven bevel gear 72 using the fixing bolts 72*a*, the driven bevel gear 72 may be welded to the front propeller hub 31, or may be integrated with the front propeller hub 31.

The plurality of reverse bevel gears 73 is tooth-engaged with one another between the driving bevel gear 71 and the driven bevel gear 72. The shafts 74 configured to support the respective reverse bevel gears 73 may installed in a direction crossing the drive shaft 10 and may be arranged radially about the drive shaft 10. In addition, the reverse bevel gear shaft 74, as exemplarily shown in FIGS. 2 and 3, may be fixed at an outer end thereof to an inner surface of the casing 75 via bolting or welding. A bearing 73*a* may be installed between each reverse bevel gear 73 and the shaft 74 supporting the reverse bevel gear for smooth rotation of the reverse bevel gear 73.

Although the present embodiment illustrates the plurality of reverse bevel gears 73, it may be unnecessary to provide the plurality of reverse bevel gears 73 so long as the reverse bevel gear 73 serves to reverse rotating direction of the driving bevel gear 71 and transmit reversed rotation to the driven bevel gear 72. In the case of a small ship having less driving load, only one reverse bevel gear may realize the above-described function.

Figure 3:
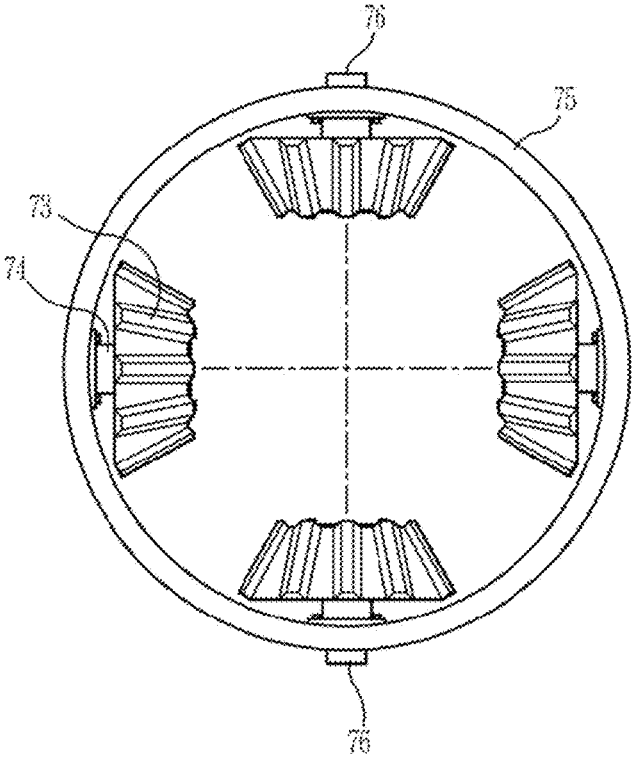
FIG. 3 is a side view showing a reverse bevel gear and casing assembly of the propulsion device according to the embodiment of the present invention.

The reverse bevel gears 73, as exemplarily shown in FIG. 3, may first be mounted to the inner surface of the casing 75 via the shafts 74 and then introduced into the installation space 4 as the casing 75 is introduced into the installation space. To this end, one or more coupling rails 76 are provided at an outer surface of the casing 75 to guide installation of the casing 75 and restrict rotation of the casing 75 after installation of the casing. The coupling rails extend in an axial direction of the drive shaft 10 by a long length and protrude from the outer surface of the casing. This serves to allow the reverse bevel gears 73, the shafts 74, and the casing 75 to constitute a single assembly for easy coupling and installation thereof.

The above-described counter rotation unit 70 enables counter rotation of the driving bevel gear 71 and the driven bevel gear 72 as the plurality of reverse bevel gears 73 reverses rotating direction of the driving bevel gear 71 and transmits reversed rotation to the driven bevel gear 72. Accordingly, it is possible to achieve counter rotation of the front propeller 30 directly connected to the driven bevel gear 72 and the rear propeller 20 directly connected to the drive shaft 10.

In addition, the counter rotation unit 70 of the present embodiment reverses rotation via the plurality of bevel gears 71, 72, and 73, thus having a smaller volume than that of a typical planetary gear type counter rotation unit. In particular, according to the present embodiment, upon installation of the counter rotation unit 70, a rear surface of the driven bevel gear 72 may face a front surface of the front propeller hub 31 and rotation centers of the driven bevel gear 72 and the hub 31 may coincide with each other, which enables direct connection between the driven bevel gear 72 and the front propeller hub 31. Accordingly, differently from the related art, it is possible to transmit power to the front propeller 30 without using an outer shaft. Moreover, absence of the outer shaft may ensure less friction of the drive shaft 10 than the related art, and consequently, ensure a smaller lubrication area than the related art. In addition, absence of the outer shaft may facilitate installation of the drive shaft 10 and center alignment of the shaft after installation thereof.

A typical planetary gear type counter rotation unit includes a sun gear installed to a drive shaft, a planetary gear around the sun gear, and a cylindrical internal gear around the planetary gear, thus having a relatively large volume. In addition, the planetary gear type counter rotation unit should have a very large volume in consideration of a casing around the internal gear because the internal gear located at an outermost position needs to rotate. In addition, it is necessary to use a hollow shaft corresponding to the typical outer shaft for power transmission from the cylindrical internal gear to the front propeller. In conclusion, the related art has difficulty in achieving a simplified configuration and reduced volume as proposed in the present embodiment.

The propulsion device of the present embodiment, as exemplarily shown in FIG. 2, includes a radial bearing 55 between the front drive shaft 10 adjacent to the counter rotation unit 70 and the housing 130 to support the drive shaft 10. The radial bearing 55 supports the drive shaft 10 at a position immediately before the counter rotation unit 70 to ensure smooth operation of the counter rotation unit. That is, the radial bearing 55 serves to prevent radial vibration or shaking of the drive shaft 10, thereby maintaining accurate tooth-engagement between the driving bevel gear 71 and the reverse bevel gears 73 as well as accurate tooth-engagement between the reverse bevel gears 73 and the driven bevel gear 72.

The propulsion device of the present embodiment, as exemplarily shown in FIG. 2, includes a first sealing unit 90 that seals a gap between a rear surface of the housing 130 and the front propeller hub 31 to prevent invasion of saltwater (or fresh water) or foreign substances, and a second sealing unit 110 that seals a gap between the front propeller hub 31 and the rear propeller hub 21 for the same purpose.

Figure 4:
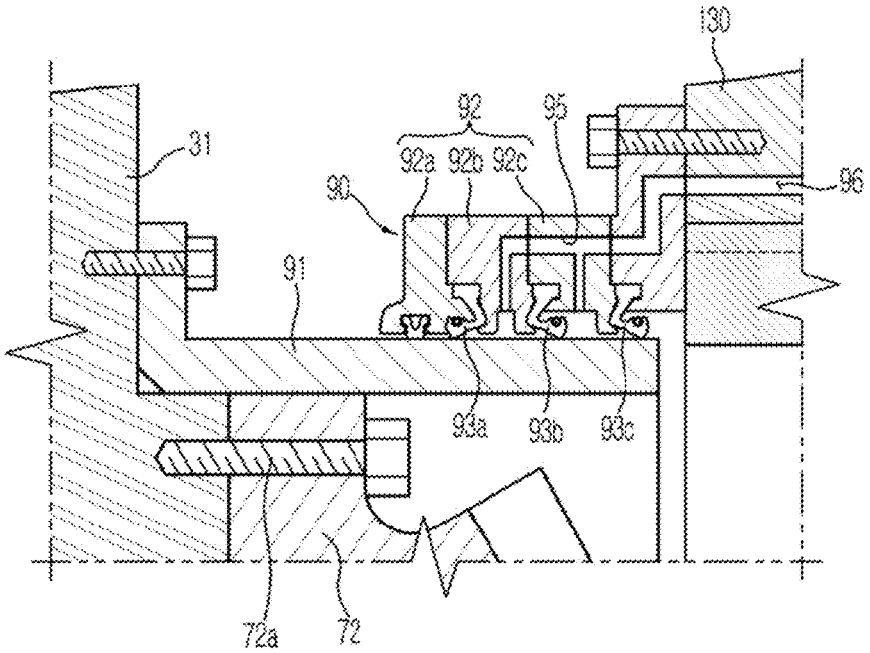
FIG. 4 is a sectional view of a first sealing unit of the propulsion device according to the embodiment of the present invention.

The first sealing unit 90, as exemplarily shown in FIG. 4, includes a first cylindrical lining 91 attached to a front surface of the front propeller hub 31, and a first cylindrical sealing member 92 configured to cover an outer surface of the first lining 91 so as to come into contact with the outer surface of the first lining 91, one end of the first sealing member 92 being secured to the hull stern part 3.

The first sealing member 92 includes a plurality of packings 93*a*, 93*b*, and 93*c* arranged at an interval on an inner surface thereof facing the first lining 91 so as to come into contact with an outer surface of the first lining 91, and a path 95 configured to supply fluid for sealing into grooves between the packings 93*a*, 93*b*, and 93*c*. The path 95 of the first sealing member 92 may be connected to a lubricant supply path 96 defined in the housing 130 to supply lubricant having a predetermined pressure. The lubricant having a predetermined pressure is supplied into the grooves between the packings 93*a*, 93*b*, and 93*c* to press the respective packings 93*a*, 93*b*, and 93*c* onto the first lining 91 until the packings come into close contact with the first lining, which may prevent invasion of saltwater or foreign substances.

Figure 5:
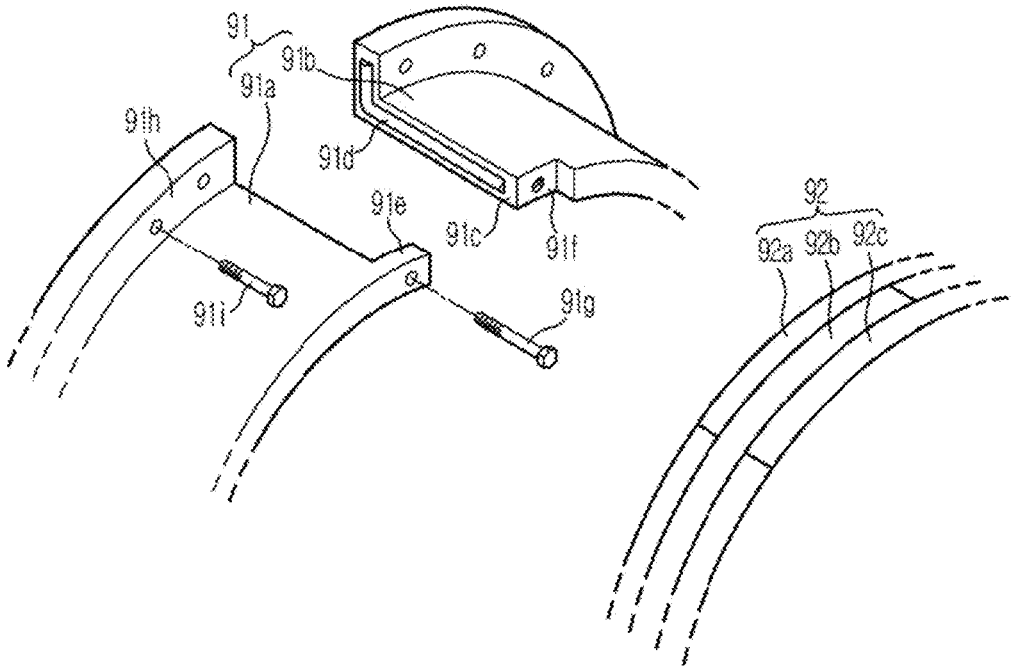
FIG. 5 is an exploded perspective view of the first sealing unit of the propulsion device according to the embodiment of the present invention.

The first lining 91, as exemplarily shown in FIG. 5, may include semicircular divided members, i.e. a first member 91*a* and a second member 91*b*, and thus may be mounted to the drive shaft 10 after the front propeller 30 is installed to the drive shaft.

In addition, a packing 91*d* may be provided at a divided portion 91*c* of any one of the first and second members 91*a* and 91*b* to achieve sealing upon coupling of the first and second members. A free end of the divided portion 91*c* of the first member 91*a* is provided with a first coupling portion 91*e* that protrudes toward the second member, and the second member 91*b* is provided with a second coupling portion 91*f* corresponding to the first coupling portion for insertion of the first coupling portion. As a fixing bolt 91*g* is fastened through the first coupling portion and the second coupling portion, strong mutual coupling of the first and second members is accomplished. A plurality of fixing bolts 91*i* may be fastened to a flange portion 91*h* fixed to the front propeller hub 31 to achieve strong fixing of the flange portion with respect to the hub 31.

In the case of the first sealing member 92, a plurality of semicircular rings 92*a*, 92*b*, and 92*c* may be stacked one above another in a longitudinal direction of the drive shaft 10 at the outside of the first lining 91 and fixed to one another. In this case, the plurality of rings 92*a*, 92*b*, and 92*c* may be coupled to one another via bolting or welding.

Figure 6:
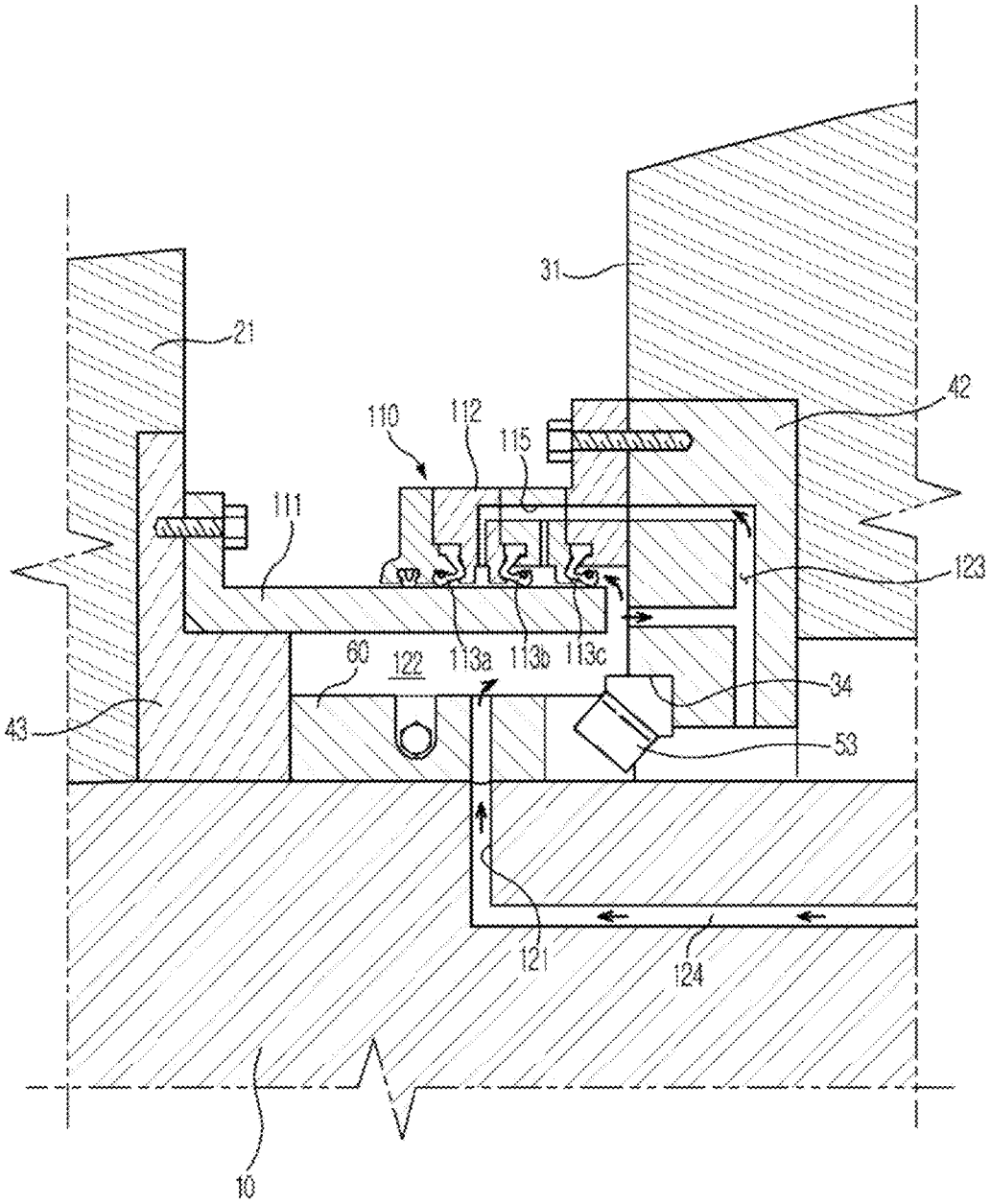
FIG. 6 is a sectional view of a second sealing unit of the propulsion device according to the embodiment of the present invention.

The second sealing unit 110, as exemplarily shown in FIG. 6, includes a second cylindrical lining 111 attached to a front surface of the rear propeller hub 21, and a second cylindrical sealing member 112 configured to cover an outer surface of the second lining 111 so as to come into contact with the outer surface of the second lining 111, one end of the second sealing member 112 being fixed to a rear surface of the front propeller hub 31. In the same manner as the first sealing member 92, the second sealing member 112 includes a plurality of packings 113*a*, 113*b*, and 113*c* arranged at an inner surface thereof and a path 115 configured to supply fluid into grooves between the packings.

The path 115 of the second sealing member 112 may be connected to a lubricant supply path 124 defined in the drive shaft 10. To this end, the drive shaft 10 and the support ring 60 may be provided with a first radial connection path 121 that connects the lubricant supply path 124 to a space 122 inside the second lining 111. The reinforcing member 42 at the rear surface of the front propeller hub 31 may be provided with a second connection path 123 that connects the space 122 inside the second lining 111 to the path 115 of the second sealing member 112. Lubricant for sealing is supplied from the center of the drive shaft 10 to the second sealing member 112 to press the packings 113*a*, 113*b*, and 113*c*, which may realize sealing.

Similar to the first lining 91 and the first sealing member 92 of the first sealing unit 90, the second lining 111 and the second sealing member 112 have a semicircular shape so as to be coupled to each other after installation of the rear propeller 20 and the support ring 60.

Next, operation of the propulsion device according to the present embodiment will be described.

In operation of the propulsion device, if the drive source 140 within the hull 1 supplies power to the motor 131 and the motor 131 rotates the drive shaft 10, the rear propeller 20 directly connected to the rear end of the drive shaft 10 is rotated in the same direction as that of the drive shaft 10. Simultaneously, the driving bevel gear 71 of the counter rotation unit 70 fixed to the drive shaft 10 is rotated along with the drive shaft 10. Rotating direction of the driving bevel gear 71 is reversed by the plurality of reverse bevel gears 73 and transmitted to the driven bevel gear 72, which causes the driven bevel gear 72 to be rotated in reverse with respect to a rotating direction of the drive shaft 10. Accordingly, the front propeller 30 directly connected to the driven bevel gear 72 and is rotated in reverse with respect to a rotating direction of the rear propeller 20.

The front propeller 30 and the rear propeller 20, which implement counter rotation, have blade angles opposite to each other, and therefore generate propulsive water streams in the same direction. That is, the front and rear propellers generate rearward propulsive water streams during forward movement of the ship, and generate forward propulsive water streams during rearward movement of the ship via counter rotation thereof. In addition, with regard to the propulsive water streams generated during forward movement of the ship, the rear propeller 20 acquires propulsive force from rotational energy of fluid having passed through the front propeller 30 via reverse rotation thereof, which results in enhanced propulsion performance. This is equally applied even during rearward movement of the ship. In addition, the steering unit may be used to change the direction of propulsive force applied to the hull 1 by the front propeller 30 and the rear propeller 20, which may change a movement direction of the ship.

Meanwhile, the front propeller 30 generates rearward propulsive water streams during forward movement of the ship, and thus is affected by corresponding repulsive force. This force is transmitted to the drive shaft 10 via the front thrust bearing 52, thereby serving as propulsive force. Similarly, the rear propeller 20 generates rearward propulsive water streams during forward movement of the ship and is affected by repulsive force. This force is similarly transmitted to the drive shaft 10 directly connected to the rear propeller, thereby serving as propulsive force.

During rearward movement of the ship, propulsive force (repulsive force) of the front propeller 30 is transmitted to the drive shaft 10 via the rear thrust bearing 53, and propulsive force of the rear propeller 20 is also transmitted to the drive shaft 10 directly connected to the rear propeller. In conclusion, the propulsion device of the present embodiment allows propulsive force generated via operation of the front propeller 30 and the rear propeller 20 during forward movement and rearward movement of the ship to be wholly transmitted to the hull 1 through the drive shaft 10.

The invention claimed is:

1. A ship propulsion device comprising:

a rear propeller fixed to a drive shaft;

a front propeller rotatably supported by the drive shaft in front of the rear propeller;

a counter rotation unit configured to reverse rotating direction of the drive shaft and transmit reversed rotation to the front propeller;

a motor configured to rotate the drive shaft;

a housing configured to extend downward from a hull and surround the counter rotation unit and the motor;

a second cylindrical lining attached to a front surface of a hub of the rear propeller for sealing between the hub of the rear propeller and the hub of the front propeller; and a second cylindrical sealing member installed to a rear surface of the front propeller so as to come into contact with an outer surface of the second lining; and a support ring interposed between the hub of the rear propeller and a rear thrust bearing provided at a rear of the hub of the front propeller.

2. The device according to claim 1, wherein the counter rotation unit includes a driving bevel gear fixed to the drive shaft, a driven bevel gear fixed to a hub of the front propeller, and one or more reverse bevel gears configured to reverse rotating direction of the driving bevel gear and transmit reversed rotation to the driven bevel gear.

3. The device according to claim 2, further comprising shafts of the reverse bevel gears installed in a direction crossing the drive shaft to support the reverse bevel gears.

4. The device according to claim 3, further comprising a casing configured to support the shafts of the reverse bevel gears.

5. The device according to claim 1, further comprising:

a first cylindrical lining attached to a front surface of the hub of the front propeller for sealing between the hub of the front propeller and a rear surface of the housing; and a first cylindrical sealing member installed to the rear surface of the housing so as to come into contact with an outer surface of the first lining.

6. A ship including a ship propulsion device according to claim 1.

* * * * *